US011078877B2

(12) United States Patent
Chia et al.

(10) Patent No.: US 11,078,877 B2
(45) Date of Patent: Aug. 3, 2021

(54) METHOD FOR SWITCHING A CURRENT IN AN ELECTROMAGNET OF A SWITCHABLE SOLENOID VALVE, ELECTRONIC CIRCUIT, SOLENOID VALVE, PUMP, AND MOTOR VEHICLE

(71) Applicant: Vitesco Technologies GMBH, Hannover (DE)

(72) Inventors: Tet Kong Brian Chia, Regensburg (DE); Dmitriy Kogan, Roding (DE)

(73) Assignee: Vitesco Technologies GmbH, Hannover (DE)

( * ) Notice: Subject to any disclaimer, the term of this patent is extended or adjusted under 35 U.S.C. 154(b) by 0 days.

(21) Appl. No.: 16/593,532

(22) Filed: Oct. 4, 2019

(65) Prior Publication Data

US 2020/0032751 A1 Jan. 30, 2020

Related U.S. Application Data

(63) Continuation of application No. PCT/EP2018/058013, filed on Mar. 28, 2018.

(30) Foreign Application Priority Data

Jun. 4, 2017 (DE) ..... 10 2017 205 884.6

(51) Int. Cl.
*F02D 41/20* (2006.01)
*F02M 59/36* (2006.01)

(52) U.S. Cl.
CPC ..... *F02M 59/368* (2013.01); *F02D 41/20* (2013.01); *F02D 2041/2044* (2013.01); *F02D 2041/2058* (2013.01); *F02D 2041/2072* (2013.01)

(58) Field of Classification Search
CPC ..... F02D 41/20; F02D 2041/2037; F02D 2041/2044; F02D 2041/2058; F02D 2041/2072; F02M 59/368
(Continued)

(56) References Cited

U.S. PATENT DOCUMENTS 6,249,418 B1 * 6/2001 Bergstrom ..... F01L 9/04 361/152
8,245,693 B2 8/2012 Sumilla et al.
(Continued)

FOREIGN PATENT DOCUMENTS

DE 10005212 A1 9/2001
DE 102005014093 A1 10/2006
(Continued)

OTHER PUBLICATIONS

Korean Notice of Allowance dated Jan. 7, 2020 for corresponding Korean Patent Application No. 10-2019-7032675.
(Continued)

*Primary Examiner* — Erick R Solis

(57) ABSTRACT

An example embodiment relates to a method for switching a current in an electromagnet of a switchable solenoid valve, wherein, in successive switching cycles, the current is in each case switched on in order to close the valve against a force of a spring, and thereby the current is generated by electrical connection of the electromagnet to a voltage source. The example embodiment makes provision for the current in the electromagnet to be generated with a current direction opposite to the respective previous switching cycle in at least two successive switching cycles in a switched operation of the valve.

14 Claims, 6 Drawing Sheets

(58) Field of Classification Search
USPC ..... 123/458, 472, 478, 490, 501, 502, 508; 361/149, 160
See application file for complete search history.

(56) References Cited

U.S. PATENT DOCUMENTS

| | | | | |
|---|---|---|---|---|
| 9,309,849 | B2 | 4/2016 | Tanabe et al. | |
| 9,447,893 | B2 | 9/2016 | Wirkowski et al. | |
| 9,624,883 | B2 * | 4/2017 | Namuduri | F02D 41/402 |
| 9,726,100 | B2 * | 8/2017 | Gopalakrishnan | F02D 41/1401 |
| 10,480,674 | B2 * | 11/2019 | Omekanda | H01F 7/081 |
| 10,557,445 | B2 | 2/2020 | Arihara et al. | |
| 2001/0043450 | A1 * | 11/2001 | Seale | F02D 41/20 361/160 |
| 2006/0103237 | A1 * | 5/2006 | Uemura | F02D 41/20 307/1 |
| 2009/0126692 | A1 * | 5/2009 | Bolz | F02D 41/20 123/490 |
| 2012/0138021 | A1 | 6/2012 | Kim et al. | |
| 2012/0167993 | A1 | 7/2012 | Fedor et al. | |
| 2013/0032212 | A1 | 2/2013 | Tokuo et al. | |
| 2015/0267660 | A1 * | 9/2015 | Nehl | H01F 7/1872 361/160 |
| 2016/0160826 | A1 | 6/2016 | Kawano et al. | |
| 2017/0306907 | A1 * | 10/2017 | Namuduri | H02K 33/16 |

FOREIGN PATENT DOCUMENTS

| | | | |
|---|---|---|---|
| DE | 102007035316 | A1 | 1/2009 |
| DE | 102015206729 | A1 | 10/2016 |
| DE | 102016204054 | B3 | 2/2017 |
| DE | 102016117995 | A1 | 3/2017 |
| JP | S59122762 | A | 12/1984 |
| KR | 970044821 | A | 7/1997 |
| KR | 20140025505 | A | 3/2014 |
| KR | 20160008791 | A | 1/2016 |
| WO | 2006060545 | A1 | 6/2006 |
| WO | 2016117400 | A1 | 7/2016 |

OTHER PUBLICATIONS

German Search Report dated Feb. 2, 2018, for corresponding German Patent Application No. 10 2017 205 884.6.
International Search Report and Written Opinion dated Jun. 13, 2018 from corresponding International Patent Application No. PCT/EP2018/058013.
Korean Notice of Allowance dated Dec. 7, 2020, for corresponding Korean Patent Application No. 10-2019-7032675.

* cited by examiner

METHOD FOR SWITCHING A CURRENT IN AN ELECTROMAGNET OF A SWITCHABLE SOLENOID VALVE, ELECTRONIC CIRCUIT, SOLENOID VALVE, PUMP, AND MOTOR VEHICLE

CROSS REFERENCE TO RELATED APPLICATIONS

This application claims the benefit of PCT Application PCT/EP2018/058013, filed Mar. 28, 2018, which claims priority to German Application DE 10 2017 205 884.6, filed Apr. 6, 2017. The disclosures of the above applications are incorporated herein by reference.

FIELD OF INVENTION

The invention relates to a method for switching a current in an electromagnet of an electrical switchable solenoid valve. A magnetic field is generated in the electromagnet by means of the current, said magnetic field closing the valve against a force of a spring. The invention also includes an electronic circuit for controlling the solenoid valve. Finally, the invention also comprises the solenoid valve comprising the electronic circuit and also a pump for an injection system of a motor vehicle and the motor vehicle.

BACKGROUND

One of the actuators used most for controlling a flow of a fluid is the solenoid valve. There are two types of solenoid valve: the proportional valve and the digital valve. For example, in a fuel injection system, the injection pressure can be controlled by means of a digital inlet valve (DIV).

Such a DIV is an electrically switchable solenoid valve that closes when an electric current in the electromagnet is applied to it, that is to say the electric current flows through the electromagnet of the valve. The valve is then closed against a force of a spring. For example, a valve disk or generally a closing element can be moved against the force of the spring from an open position to a closed position. In the currentless state, the valve then opens automatically on account of the force of the spring and is held there in the open position by the spring until a current flows through the electromagnet again. The current profile for closing the solenoid valve is a peak current, which provides the activation energy to close the valve. Subsequently, the current is changed to a holding current at which the magnetic field of the electromagnet is set to hold the valve in the closed position. This is known, for example, from US 2012/0167993 A1.

Due to the rapid switching processes of such an inlet valve particularly in a pump of a fuel injection system of a motor vehicle, undesired noise emission is produced and wear of the components occurs whenever the closing element hits the respective end stop for the closed position (electromagnet is energized) and the open position (spring pushes open the valve).

WO 2006/060545 A1 discloses a method for reducing the noise emission of a solenoid valve of a fuel injection pump. The method requires complex switching pulses.

Known methods for reducing the noise emission require complex regulation or control of the current profile, wherein, in the event of a faulty configuration, it may be that the current profile is not sufficient to close the valve successfully.

SUMMARY

Embodiments of the invention are based on providing a measure for reducing the noise emission and/or the wear of a solenoid valve in a manner that is technically simple to implement.

The embodiments provide a method for switching a current in an electromagnet of an electrically switchable solenoid valve. The solenoid valve operates in the manner known per se, that is to say, in successive switching cycles, the current is in each case switched on in order to close the valve against a force of a spring, that is to say to move a closure element of the valve against the force of the spring from an open position to a closed position. In this case, the current is generated by electrically connecting the electromagnet (solenoid) to a voltage source. After the current is switched off, the valve may then be opened again by the force of the spring, which then completes the switching cycle.

The embodiments control the electromagnet by means of the current in the manner known from the prior art, namely by applying or setting a peak current to close the valve and by subsequently setting a holding current to hold the valve in the closed position. Contrary to the prior art, however, the current is now generated with alternating polarity. The polarity is changed or switched in successive switching cycles. This operating mode is therefore referred to in the following text as switched operation. In the switched operation of the valve, the current in the electromagnet is thus generated in each case with a current direction or polarity opposite to the respective previous switching cycle in at least two successive switching cycles. To this end, the electromagnet may be operated in a four-quadrant operation. This reduces an acceleration force or the acceleration with which the closure element of the valve is moved from the open position to the closed position. In other words, the closure element of the valve strikes with a lower end speed in the end position of the closed position than when the polarity stays the same. The reason for this is that the polarity of the electromagnet has to be reversed, that is to say, when the current with reversed polarity is switched on, the magnetic remanence in the soft-magnetic material of the electromagnet is first dissipated before an acceleration or movement of the closure element of the valve may occur. This reduces the temporal gradient or the temporal rise of the current flowing in the electromagnet when the voltage source is switched on, which results in a correspondingly temporally slower rise in the magnetic force. The remanence field strength of the electromagnet at the switch-on time of the current does not contribute in the acceleration of the closure element, but it is exclusively the electric current that ultimately leads to acceleration of the closure element. Overall, this produces a reduced acceleration of the closure element in comparison to a constant operation in which the current direction is kept the same in the subsequent switching cycles. The switched operation reduces overall the end speed of the closure element that it has when striking or driving into the end positions. As a result, noise emission and/or wear are reduced.

The invention also includes developments that produce additional advantages.

To set or change the polarity of the current, a connection direction of two connections of the electromagnet is preferably changed with respect to connection poles of the voltage source by means of a switching device for reversing the current direction. For this purpose, the switching device may have transistors, for example. Thus, if the electromagnet has a first connection and a second connection, the first connection is electrically connected to the first connection pole and the second connection is electrically connected to the second connection pole in one switching cycle and, to reverse the current direction, the first connection is electrically connected to the second connection pole and the second connection is electrically connected to the first connection pole in the next switching cycle. The switching device may thus be implemented by way of simple switching elements and, as a result thereof, the advantageous effect of the invention may be achieved.

In particular, provision is made for the current direction of the current to be set by means of a full-bridge of a bridge circuit (H-bridge). In other words, the switching device is thus implemented as a bridge circuit comprising four switching elements. This results in the described four-quadrant operation. Another designation for such a bridge circuit is also four-quadrant actuator.

It is particularly advantageous here for it to be possible to also change between the switched operation and said constant operation in which the current direction is kept the same in the subsequent switching cycles. This preferably occurs depending on a switchover signal, by way of which a switchover is made between the switched operation and the constant operation.

This is particularly interesting for the case that an injection valve of a high-pressure pump of a fuel injection system of a motor vehicle is controlled as the valve. "High-pressure" is to be understood in connection with the invention as meaning, in particular, a pressure of more than 100 bar.

In this context, the switchover between switched operation and constant operation may take place depending on an idle operation of an internal combustion engine of the motor vehicle. In idle operation, operating noise of an injection valve, that is to say the noise emission thereof, is louder in comparison to the other operating noises of the motor vehicle. In this case, the switchover to the switched operation is then expedient. In contrast, if the internal combustion engine drives the motor vehicle (internal combustion engine is engaged), other operating noises are produced, which generally drown out the noise emission of the injection valve in such a way that it is possible to change to the constant operation without the injection valve being able to be heard as a result.

To be able to carry out the method according to the invention in a solenoid valve, the invention provides an electronic circuit, which is configured to carry out an embodiment of the method according to the invention. The electronic circuit may have a microcontroller for this purpose. Furthermore, the electronic circuit may have the described bridge circuit for switching the electric current for the electromagnet.

The embodiments also include a solenoid valve having an electromagnet, said solenoid valve being configured to close the valve against a force of a spring when a current flows through the electromagnet. Furthermore, the valve may have an embodiment of the electronic circuit according to the invention.

The electronic circuit may thus include the switching device for switching the current. The switching device may in this case have the bridge circuit including a full-bridge, wherein the bridge circuit is configured to change a connection direction of two connections of an electromagnet with respect to connection poles of a voltage source.

The embodiments also include a pump for an injection system of a motor vehicle. The pump has the solenoid valve according to the embodiments. The pump may thus be an injection pump, in particular a high-pressure pump.

Finally, the embodiments also include a motor vehicle having an internal combustion engine, for example a diesel engine or Otto engine, which has a fuel injection system including an embodiment of the pump according to the embodiments.

The motor vehicle according to the invention may be an automobile, in particular a passenger car or commercial vehicle.

BRIEF DESCRIPTION OF THE DRAWINGS

An exemplary embodiment of the invention is described in the following text. In this respect.

DETAILED DESCRIPTION

The example embodiment explained below is a preferred embodiment of the invention. In the context of the example embodiment, the described components of the embodiment in each case represent individual features which are to be considered independently of one another and which in each case also refine the invention independently of one another, and are therefore to be considered individually or in a combination other than that shown, as a constituent part of the invention.

Furthermore, the described embodiment may also be complemented by others of the already described features of the invention.

In the figures, functionally identical elements are provided in each case with the same reference signs.

Figure 1:
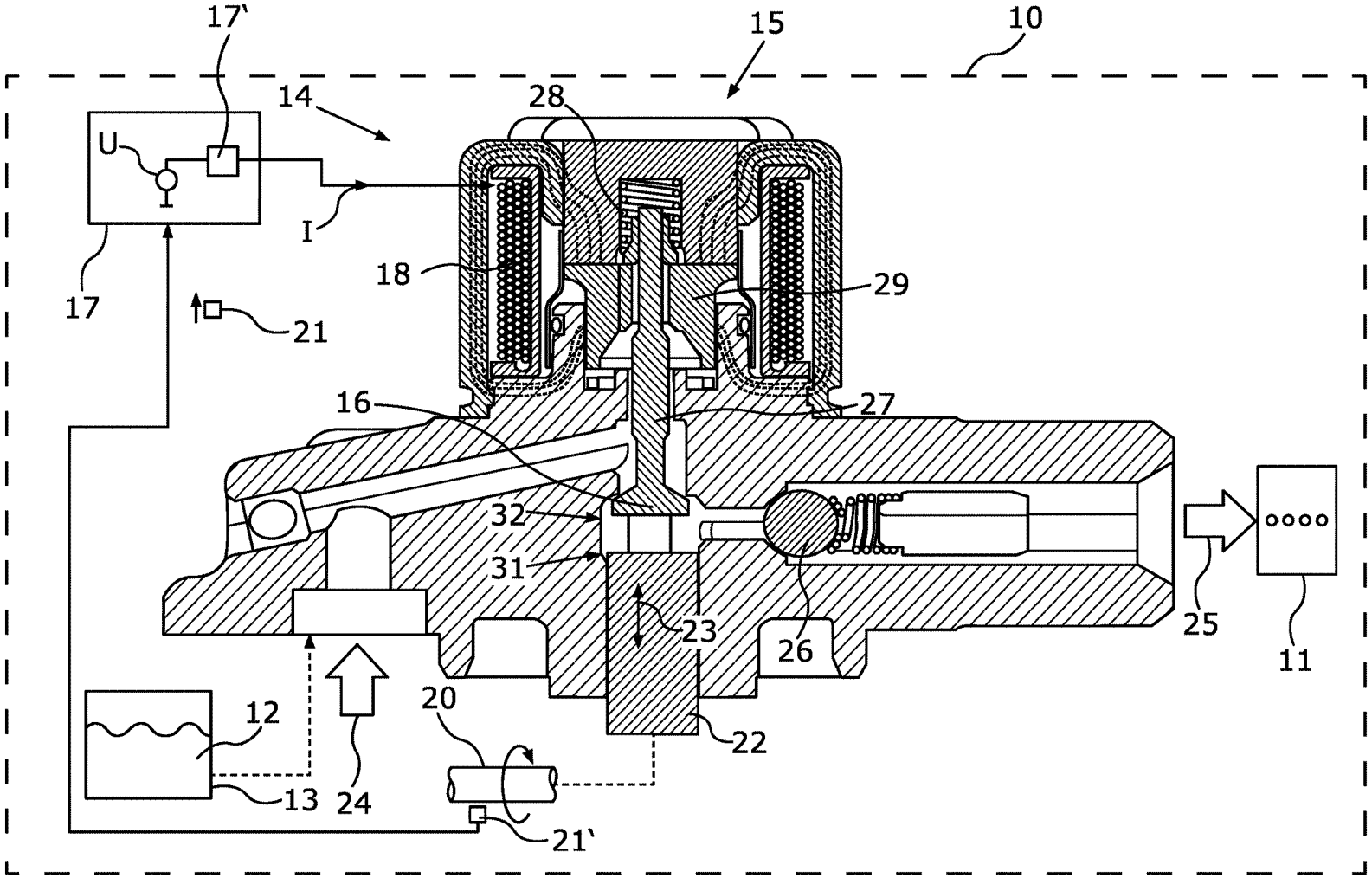
FIG. 1 shows a schematic illustration of an embodiment of the motor vehicle.

FIG. 1 shows a motor vehicle 10, which may be, for example, a passenger car or a commercial vehicle. The motor vehicle 10 may have an internal combustion engine 11, which may be operated one the basis of a fuel 12 from a fuel tank 13. The fuel 12 may be pumped out of the fuel tank 13 to the internal combustion engine 11 by means of a pump 14. The pump 14 may be an injection pump. The pump 14 may have a switchable solenoid valve 15, for example a DIV, including a closure element 16, for example a valve disk, and an electromagnet 18 including an electric coil. An electric current I for the electromagnet 18 may be controlled by an electronic circuit 17, which may have a switching device 17' for switching the current I. An operation of the valve 15 may be coordinated with a rotation of a crankshaft 20 by virtue of a rotational position of the crankshaft 20 being detected and the electric current I being switched depending on the rotational position. The rotational position may be measured by means of a rotational position sensor 21'. The crankshaft 20 moves a piston 21 of the pump 14 in a pump movement 23 in order to pump the fuel 12 from a low-pressure side 24 to a high-pressure side 25, where the fuel 12 is then injected by a fuel injection system. An outlet valve 26 of the pump may be a passive valve, for example a check valve, and the inlet valve may be formed by the described solenoid valve 15 including the closure element 16 thereof. To close the valve 15, the current I is driven through the electromagnet 18 so that as a result a rod or pin 27 that holds the closure element 16 is drawn against a spring force of a spring 28 to a pole piece 29 comprising an armature, with the result that the closure element 16 is moved or drawn from an open position 31 to a closed position 32. The current I may be generated by a voltage source U, which is electrically interconnected or connected for this purpose to the electromagnet 18 by means of the switching device 27'.

Switching off the voltage source U results in an exponential drop in the current I in the electromagnet 18. As soon as the spring force of the spring 28 is then stronger than the magnetic field of the electromagnet 18 and of the pressure remaining in the pump, the closure element 16 is moved back from the closed position 32 to the open position 31. This then ends a full switching cycle or pump cycle of the pump.

Figure 2:
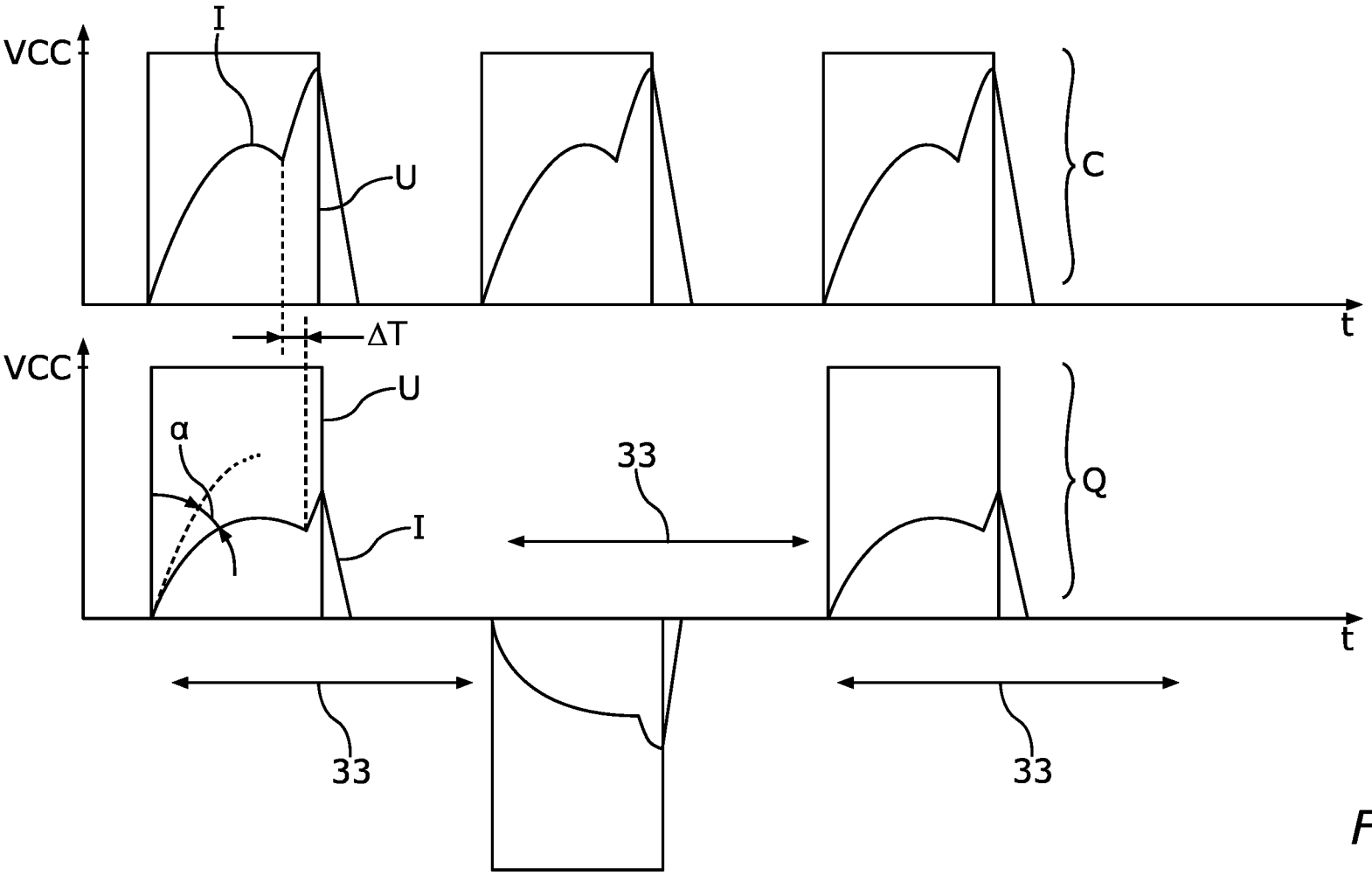
FIG. 2 shows a graph of current profiles of a current in a solenoid valve of the motor vehicle of FIG. 1.

FIG. 2 shows a time profile of the current I over time t and the switched voltage of the voltage source U at the electromagnet 18, and specifically once for a normal operation or constant operation C and once for a four-quadrant operation or switched operation Q. It is shown that a polarity of the switched voltage of the voltage source U and therefore of the current I remains constant for successive switching cycles in normal operation C, whereas, in switched operation Q, successive switching cycles 33 have an alternating polarity of the switched voltage of the voltage source U and therefore of the resulting current I in the electromagnet 18. In other words, the current direction of the current is alternated or reversed in successive switching cycles 33. Furthermore, a comparison of a gradient or a rise in the current I is illustrated, as is produced in comparison between the constant operation C and the switched operation Q. The gradient is lower by a gradient angle $\alpha$ when the switched operation Q is used.

Figure 3:
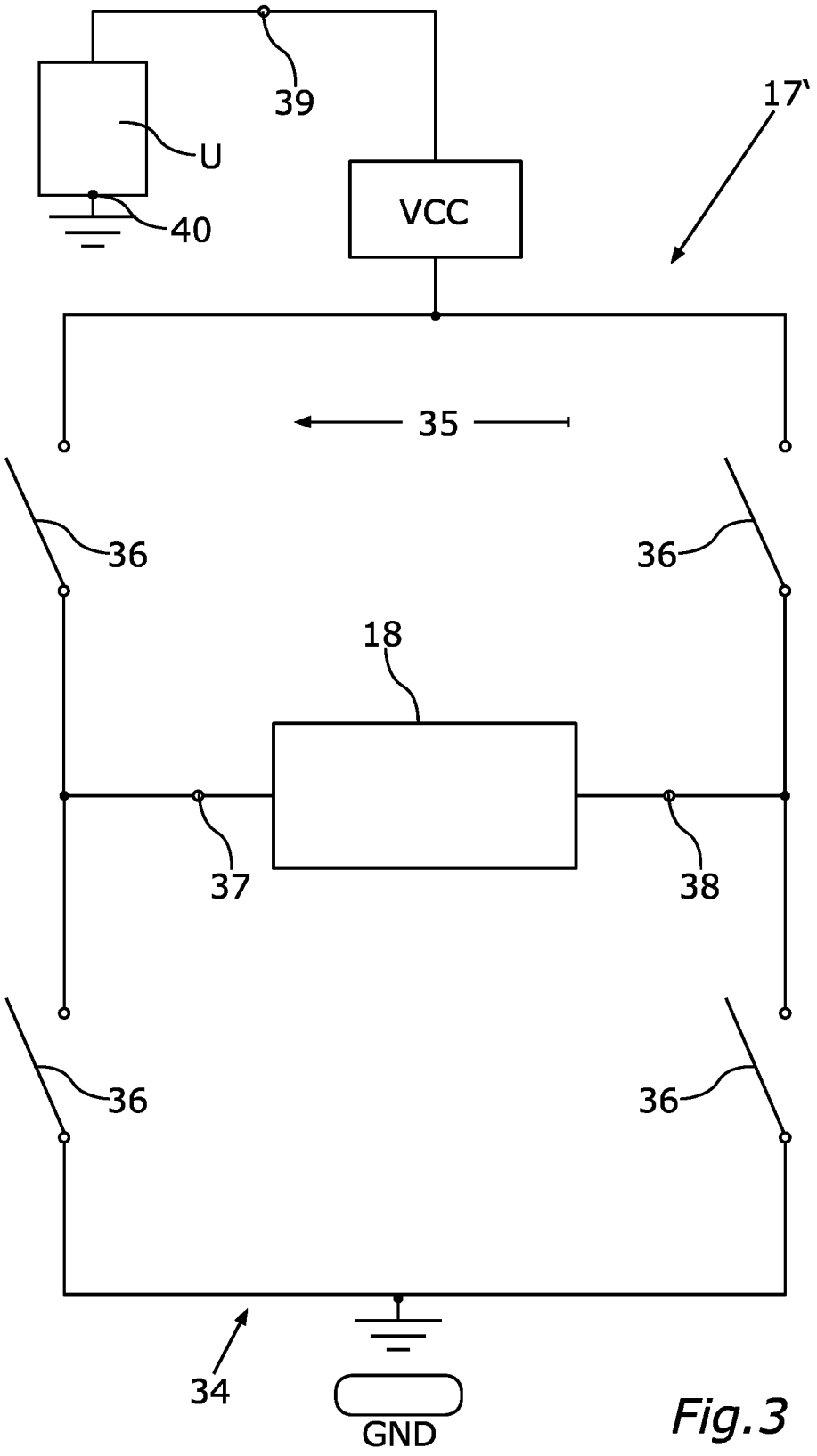
FIG. 3 shows a schematic illustration of a switching device, which controls the current.

FIG. 3 shows how the current direction or polarity of the current I may be set by means of the switching device 17'. The electromagnet 18, the switching device 17' and the interconnection with the voltage source U, which provides the supply voltage VCC, are illustrated. The voltage source U may be, for example, a battery of the motor vehicle 10.

The switching device 17' may have a bridge circuit 34 comprising the full-bridge 35 such that there are four switching elements 36 overall, for example in each case a transistor, in order to electrically connect a respective connection 37, 38 of the electromagnet 18 to the poles 39, 40 of the voltage source U in alternation. The circuit may be closed in each case a means of a ground potential GND.

Figure 4:
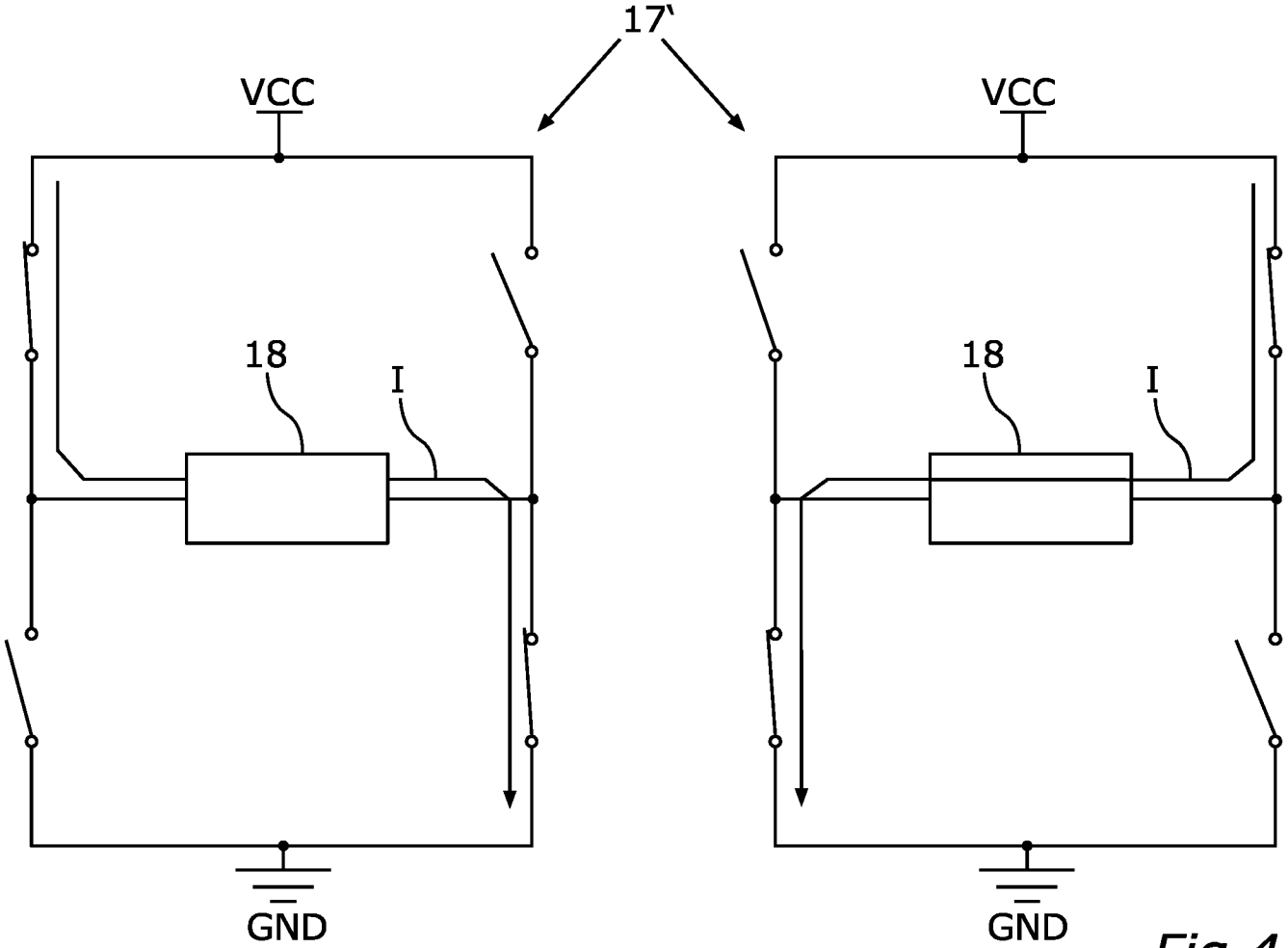
FIG. 4 shows two switching states of the switching device of FIG. 3, by way of which switchover of the current direction in the solenoid valve is achieved.

FIG. 4 illustrates two possible switching positions of the switching device 17', which permit or make it possible to switch over the current direction of the current I in the electromagnet 18 between two switching cycles 33.

Figure 5:
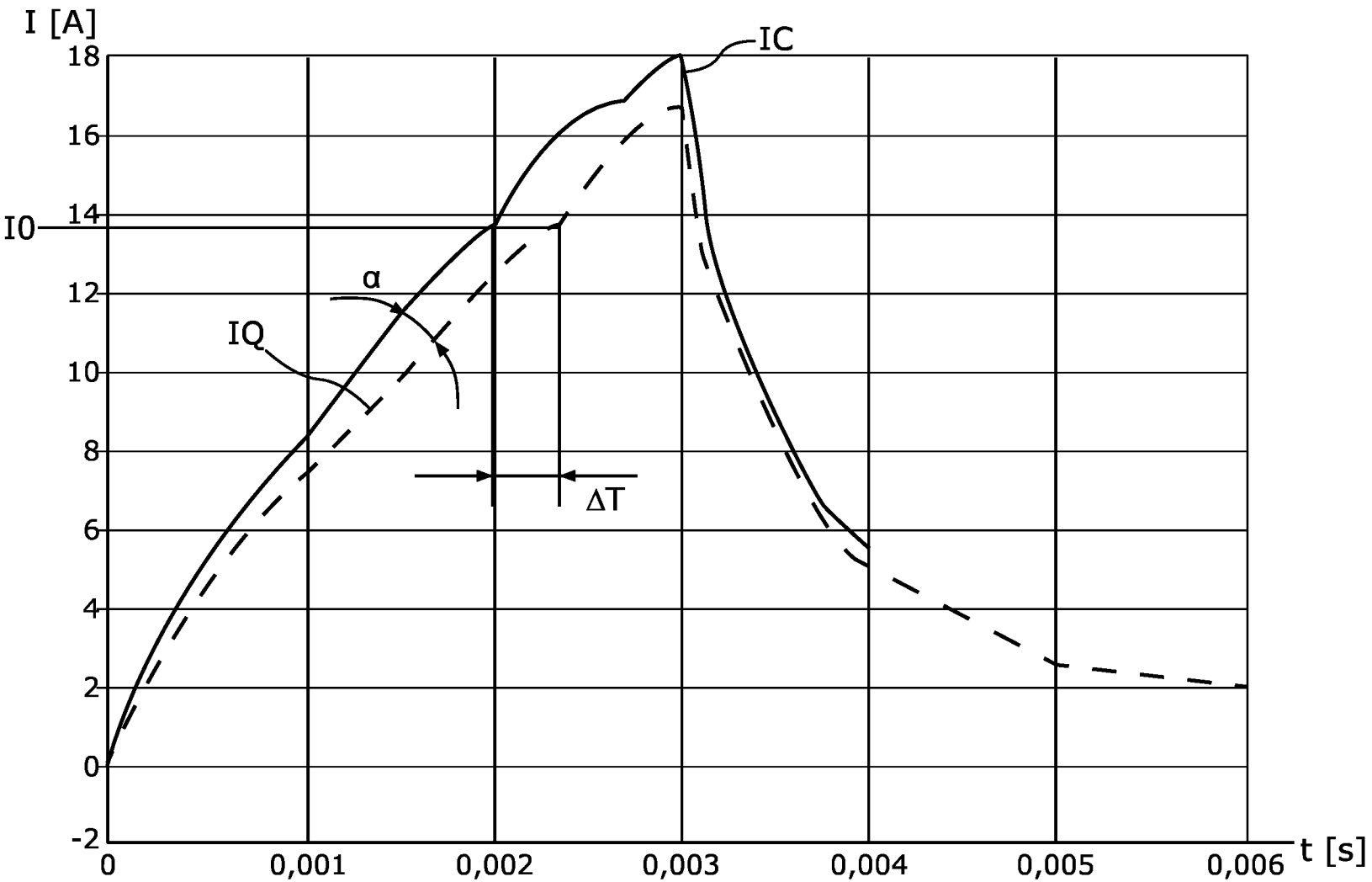
FIG. 5 shows a diagram of the resulting current intensity due to the change in accordance with FIG. 4.

FIG. 5 shows once again in detail the comparison of the resulting gradient of the current I, once with the current I in constant operation (IC) and once with the current I in the case of a switching cycle during switched operation (IQ). The current I reaches a prescribed current intensity I0 during switched operation Q in comparison with constant operation C by a time delay $\Delta T$ later on account of the difference a in the rise gradient of the current I.

By switching the electromagnet in four-quadrant operation or switched operation Q, the polarity of the magnetic field is also switched over or changed or reversed with each switching cycle 33. Since ferromagnetic material is also present in the electromagnet 18, the electromagnet 18 retains magnetization (magnetic remanence effect) after each switching cycle 33. Said remaining magnetization even without a flow of current is produced on account of the magnetic dipoles in the soft-magnetic material, said magnetic dipoles remaining in the orientation of the last magnetization. If, however, the current with alternating current direction is now applied such that the magnetic field also has a different polarity or polarization with each switching cycle 33, said remaining magnetization must initially be reduced or dissipated until it reaches 0. Said change of magnetization of the soft-magnetic material consumes or requires a prescribed energy content, which is referred to as magnetic coercive field strength.

Said dissipation of the remaining magnetization and the energy required therefor reduces the rise in current intensity of the current I after switch-on at the beginning of a switching cycle 33. The energy is used to demagnetize or change the magnetization for the polarity reversal of the soft-magnetic material. The reduction in the gradient by the difference a has the advantageous effect that the acceleration of the closure element 16 is reduced and therefore noise emission and/or wear of the solenoid valve 15 are reduced.

Figure 6:
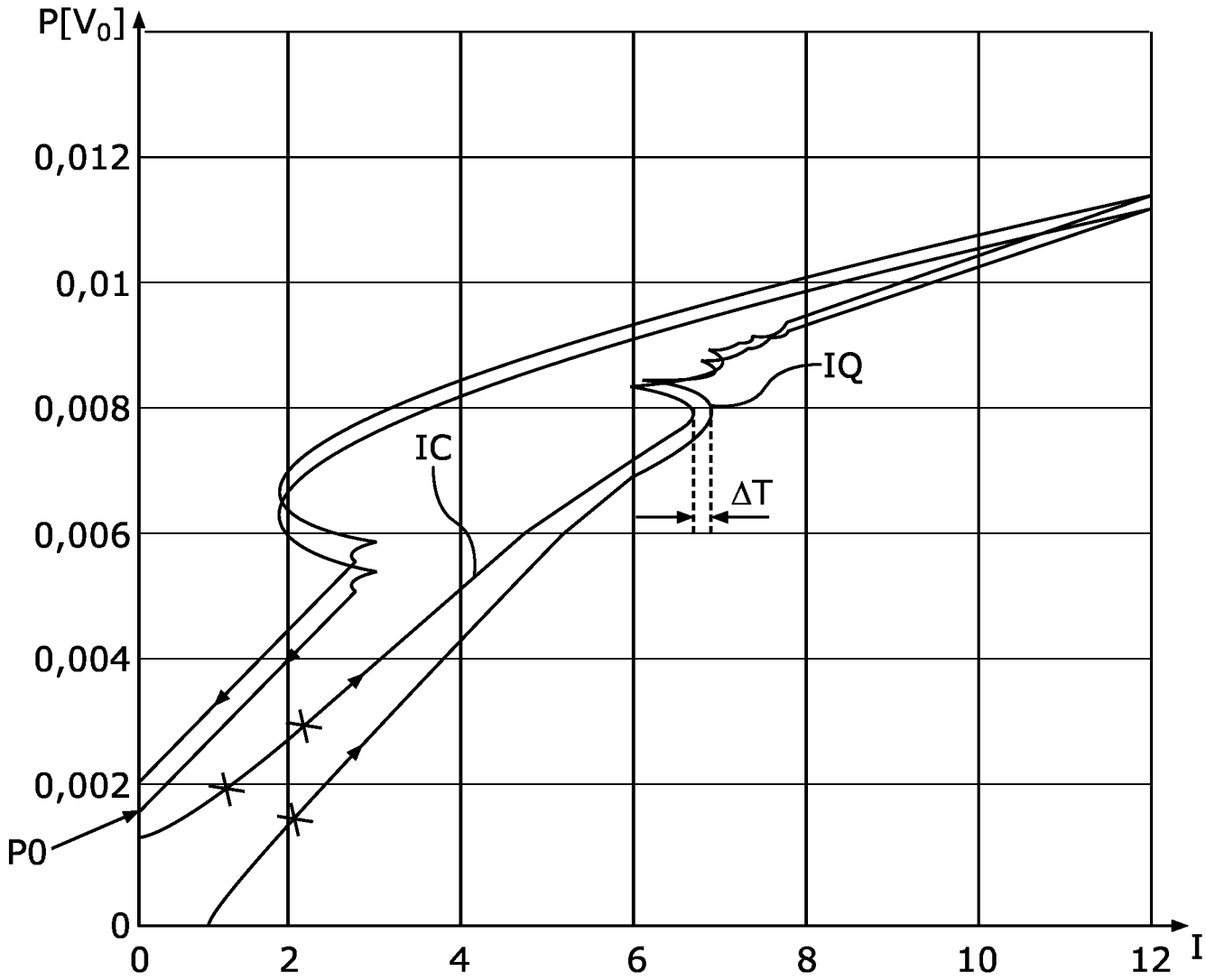
FIG. 6 shows a graph with curves which illustrate a relation between current intensity and magnetic flux in the solenoid valve.

A second effect is illustrated in FIG. 6. FIG. 6 shows the magnetic flux P, as may be produced during a switching cycle 33, against the current intensity of the current I. In switched operation Q, in comparison to constant operation C, an increase $\Delta I$ of the switch-on current intensity of the current I is produced. This shows that more current I is required to achieve the same magnetic force to close the valve 15. The magnetic force is required to overcome the spring force of the spring 28. This effect of the increase $\Delta I$ is caused by the fact that the magnetic flux P now has to be built up from 0 and does not begin from an offset value P0 as is possible during constant operation C on account of the consistent orientation of the magnetic field. This means that during constant operation C the magnetic force is already oriented in the direction provided for the switching cycle 33 when the current I is switched on and therefore contributes to accelerating the closure element 16. In other words, the remaining magnetization has a promoting effect on the acceleration of the closure element 16. In contrast, in four-quadrant operation or switched operation Q, the overall acceleration is affected by the current itself.

By reducing the temporal gradient of the current I, a reduced temporal rise or a reduced temporal rate of rise of the magnetic force is therefore produced overall on account of the lack of remaining magnetization P0. The magnetic force is applied or generated completely by the electric current I that increases to a lower extent or more slowly as a result. This reduces the acceleration of the closure element 16. A reduction in the noise emission and/or the wear of the valve 15 on account of the reduced end speed before driving into the closed position 32 are the advantageous consequences.

Overall, the example shows how the invention may provide a method for controlling noise emission and/or component wear for an electrically switchable solenoid valve.

The invention claimed is:

1. A method for switching a current in an electromagnet of a switchable solenoid valve, comprising:

in successive switching cycles, switching the current on in order to close the switchable solenoid valve against a force of a spring of the switchable solenoid valve, and thereby generating the current by electrical connection of the electromagnet to a voltage source, wherein the current in the electromagnet is generated with a current direction opposite to the respective previous switching cycle in at least two successive switching cycles in a switched operation of the switchable solenoid valve, wherein, depending on a switchover signal, a switchover is made between the switched operation and a constant operation in which the current direction is kept the same in the successive switching cycles.

2. The method as claimed in claim 1, wherein a connection direction of two connections of the electromagnet is changed with respect to connection poles of the voltage source by a switching device for reversing the current direction.

3. The method as claimed in claim 1, wherein the current direction of the current is set by a bridge circuit.

4. The method as claimed in claim 1, wherein an injection valve of a high-pressure pump of a fuel injection system of a motor vehicle is controlled as the switchable solenoid valve.

5. A method for switching a current in an electromagnet of a switchable solenoid valve, comprising:

in successive switching cycles, switching the current on in order to close the switchable solenoid valve against a force of a spring of the switchable solenoid valve, and thereby generating the current by electrical connection of the electromagnet to a voltage source, wherein the current in the electromagnet is generated with a current direction opposite to the respective previous switching cycle in at least two successive switching cycles in a switched operation of the switchable solenoid valve, wherein an injection valve of a high-pressure pump of a fuel injection system of a motor vehicle is controlled as the switchable solenoid valve, and wherein, depending on a switchover signal, a switchover is made between the switched operation and a constant operation in which the current direction is kept the same in the successive switching cycles, and the switchover is made between the switched operation and the constant operation depending on an idle operation of an internal combustion engine of the motor vehicle.

6. An electronic circuit for controlling a solenoid valve, comprising:

a switching circuit connected between a voltage source and an electromagnet of the solenoid valve, the switching circuit comprising a plurality of transistors coupled to the electromagnet; and a controller which controls the transistors so that in successive switching cycles during a switched operation of the solenoid valve, current passing through the electromagnet is switched in each cycle in order to close the solenoid valve against a force of a spring of the solenoid valve, wherein a direction of a current in a first switching cycle of the successive switching cycles is opposite to the direction of the current in an immediately prior switching cycle of the successive switching cycles, wherein the controller selectively switches control of the switching circuit between the switching operation and a constant operation in which the direction of the current remains the same in successive switching cycles.

7. The electronic circuit as claimed in claim 6, wherein the switching circuit comprises a full-bridge switching circuit.

8. The electronic circuit as claimed in claim 6, wherein the solenoid valve forms part of a fuel pump.

9. The electronic circuit as claimed in claim 6, wherein the controller switches control of the switching circuit between the switching operation and the constant operation based upon a state of a switchover signal.

10. The electronic circuit as claimed in claim 6, wherein the solenoid valve forms part of a fuel pump of a motor vehicle having an internal combustion engine, and wherein the controller switches control of the switching circuit between the switching operation and the constant operation based upon the internal combustion engine idling.

11. A motor vehicle, comprising:

an internal combustion engine which has a fuel injection system, the fuel injection system comprising:

a fuel tank;

a fuel pump in fluid communication with the fuel tank and comprising a solenoid valve; and an electronic circuit electrically coupled to the solenoid valve and comprising a switching circuit connected between a voltage source of the motor vehicle and an electromagnet of the solenoid valve, the switching circuit comprising a plurality of transistors, and a controller which controls the transistors so that in successive switching cycles during a switched operation of the solenoid valve, current passing through the electromagnet is switched in each switching cycle in order to close the solenoid valve against a force of a spring of the solenoid valve, wherein a direction of a current in a first switching cycle of the successive switching cycles is opposite to the direction of the current in an immediately prior switching cycle of the successive switching cycles, wherein the controller selectively switches control of the switching circuit between the switching operation and a constant operation in which the direction of the current remains the same in successive switching cycles.

12. The motor vehicle as claimed in claim 11, wherein the switching circuit comprises a full-bridge switching circuit.

13. The motor vehicle as claimed in claim 11, wherein the controller switches control of the switching circuit between the switching operation and the constant operation based upon a state of a switchover signal.

14. The motor vehicle as claimed in claim 11, wherein the controller switches control of the switching circuit between the switching operation and the constant operation based upon whether or not the internal combustion engine is in an idle state.

* * * * *